US007645098B1

(12) United States Patent
Rainey

(10) Patent No.: US 7,645,098 B1
(45) Date of Patent: Jan. 12, 2010

(54) MODULAR RETAINING WALL BLOCK WITH ENHANCED STACKING ABILITY

(75) Inventor: Thomas L. Rainey, Marietta, GA (US)

(73) Assignee: Earth Reinforcement Technologies, LLC, Woodstock, GA (US)

( * ) Notice: Subject to any disclaimer, the term of this patent is extended or adjusted under 35 U.S.C. 154(b) by 0 days.

(21) Appl. No.: 12/338,171

(22) Filed: Dec. 18, 2008

(51) Int. Cl.
*E02D 5/00* (2006.01)
*E02D 17/20* (2006.01)

(52) U.S. Cl. ..... 405/284; 405/286; 52/604

(58) Field of Classification Search ..... 405/284, 405/286; 52/601, 604
See application file for complete search history.

(56) References Cited

U.S. PATENT DOCUMENTS 5,921,715 A 7/1999 Rainey
6,035,599 A * 3/2000 Sonnentag ..... 52/604
6,322,291 B1 11/2001 Rainey
6,338,597 B1 1/2002 Rainey
6,416,257 B1 7/2002 Rainey
6,612,784 B2 9/2003 Rainey et al.
6,652,196 B1 11/2003 Rainey
6,758,636 B2 7/2004 Rainey et al.
7,114,887 B1 10/2006 Rainey
7,390,146 B2 6/2008 Rainey

* cited by examiner

*Primary Examiner*—Tara Mayo-Pinnock
(74) *Attorney, Agent, or Firm*—Thomas, Kayden, Horstemeyer & Risley LLP

(57) ABSTRACT

One embodiment of modular wall blocks of the present disclosure can be implemented as follows. An interlocking retaining wall block, adapted for assembly into a retaining wall including a plurality of stacked rows of at least a plurality of said blocks. The block includes left, right, front and rear body portions, and left and right protruding body portions extending outwardly in left and right directions from said left and right body portions, respectively. The block further includes left and right aligning elements extending upwardly from an upper surface of said left and right protruding body portions, respectively, each of said aligning elements having an upper surface that is angled downwardly from rear to front, each of said aligning elements being operable to be received by a void of another one of said blocks.

6 Claims, 11 Drawing Sheets

(A)

(B)

(C)

MODULAR RETAINING WALL BLOCK WITH ENHANCED STACKING ABILITY

TECHNICAL FIELD

The present disclosure is generally related to earth reinforcement and, more particularly, is related to modular retaining wall structures.

BACKGROUND

Modular earth retaining walls are commonly used for architectural and site development applications. A variety of retaining wall structures and reinforcement systems exist, such as those disclosed in U.S. Pat. Nos. 5,921,715; 6,322,291 B1; 6,338,597 B1; 6,416,257 B1; 6,652,196; 6,612,784 B2; 6,758,636 B2; 7,114,887 B1; and 7,390,146; all of which are entirely incorporated herein by reference. Generally, the modular earth retaining walls are constructed of modular blocks. However, it is not uncommon for these modular blocks to be damaged during storage and/or transportation.

SUMMARY

Embodiments of the present disclosure provide modular wall blocks which may be safely stacked for storage and/or transportation. Briefly described, one embodiment of the blocks, among others, can be implemented as follows.

An interlocking retaining wall block, adapted for assembly into a retaining wall including a plurality of stacked rows of at least a plurality of said blocks. The block includes left, right, front and rear body portions, said front and rear body portions of said block being connected by said left and right body portions, defining a void therebetween. The block further includes left and right protruding body portions, said left and right protruding body portions extending outwardly in left and right directions from said left and right body portions, respectively. The block further includes left and right aligning elements extending upwardly from an upper surface of said left and right protruding body portions, respectively, each of said aligning elements located forward of an exterior face of said rear body portion and rearward of an interior face of said front body portion on each of said left and right protruding body portions, each of said aligning elements having an upper surface that is angled downwardly from rear to front, each of said aligning elements being operable to be received by a void of another one of said blocks. The block further includes a substantially planar bottom surface of said block.

Other systems, methods, features, and advantages of the present disclosure will be or become apparent to one with skill in the art upon examination of the following drawings and detailed description. It is intended that all such additional systems, methods, features, and advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
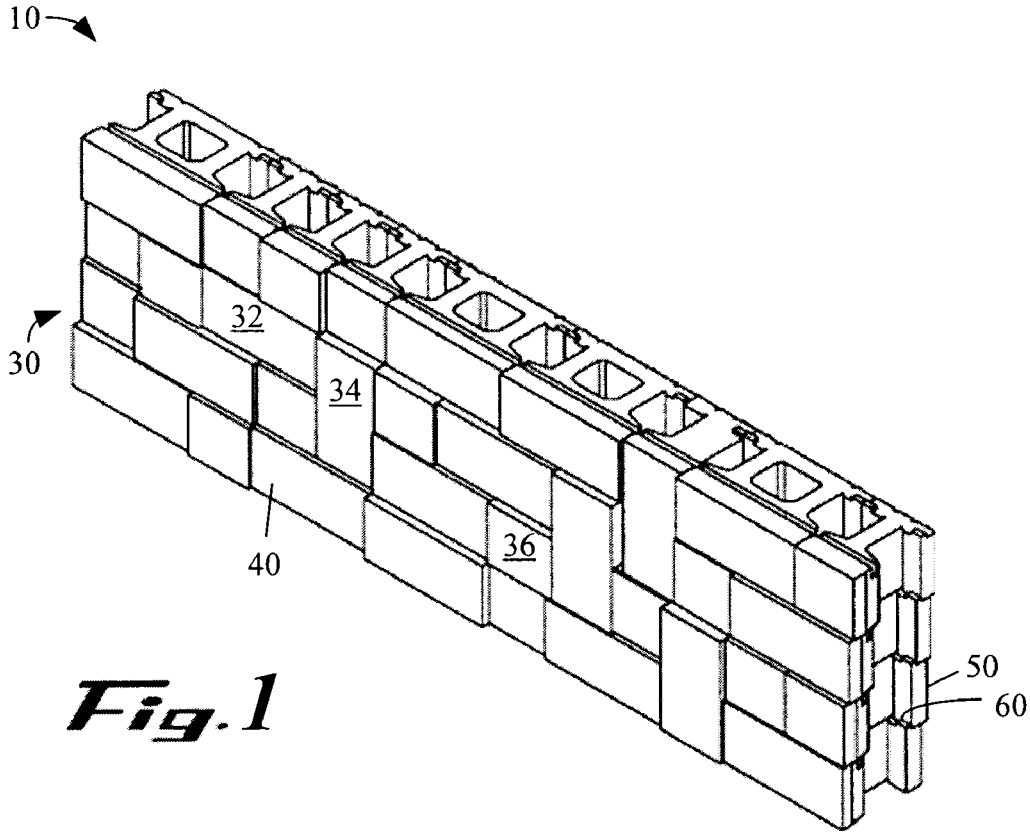
FIG. 1 is a diagram of one embodiment of a modular retaining wall in accordance with the present disclosure.

Referring now in detail to the drawings, in which like numerals indicate corresponding parts throughout the several views, FIG. 1 illustrates an embodiment of a modular or segmental retaining wall 10 in accordance with the present disclosure. As depicted in this figure, the retaining wall 10 comprises a plurality of wall blocks 30 that are stacked atop each other. The wall blocks 30, when stacked together, form an exterior surface 40 of the wall 10 which faces outwardly away from an earth embankment, and an interior surface 50 of the wall 10 which faces inwardly toward the embankment. Typically, the blocks 30 are stacked in a staggered arrangement as shown in FIG. 1 to provide greater stability to the modular retaining wall 10 and to provide ornamental decoration.

Modular or segmental retaining walls commonly comprise courses or tiers of modular units or blocks. The blocks are typically made of concrete. The blocks are typically dry-stacked (no mortar or grout is used), and often include one or more features adapted to properly locate adjacent blocks and/or courses with respect to one another, and to provide resistance to shear forces from course to course. The weight of the blocks is typically in the range of ten to one hundred fifty pounds per unit. Modular retaining walls commonly are used for architectural and site development applications. Such walls are subjected to high loads exerted by the soil behind the walls. These loads are affected by, among other things, the character of the soil, the presence of water, temperature and shrinkage effects, and seismic loads. To handle the loads, modular retaining wall systems often comprise one or more layers of soil reinforcement material extending from between the tiers of blocks back into the soil behind the blocks.

Generally speaking, the modular blocks 30, in one embodiment, are comprised of, but not limited to, three blocks of different size and shape. In one configuration, each block is configured so as to mate with at least one other block when the blocks are stacked atop one another to form the modular retaining wall 10. This mating restricts relative movement between vertically adjacent blocks in at least one horizontal direction and allows adjacent courses to be setback from one another. To provide for this mating, the blocks 30 can include locking means 60, such as a raised notch or node, that secure the blocks together (e.g., by engaging against a bottom surface of an adjacent upper block) to further increase wall stability.

Figure 2:
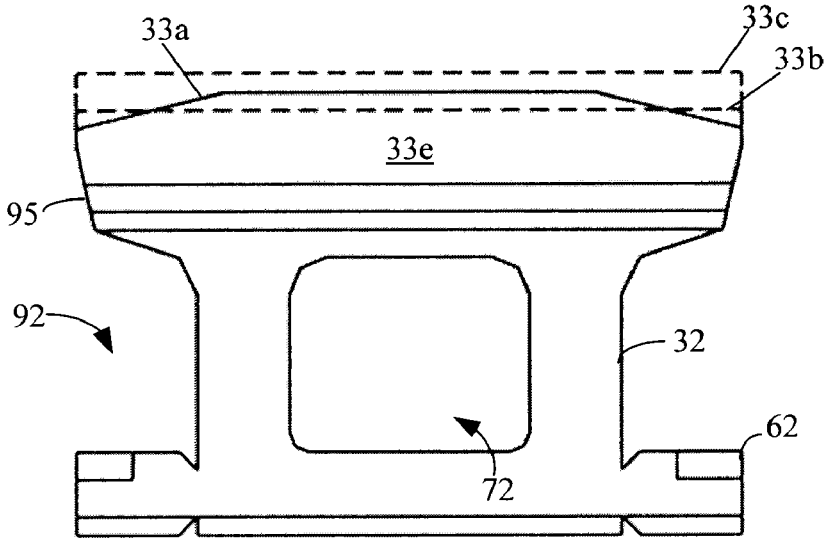
FIG. 2 is a diagram of a top view of one embodiment of a long horizontal block that is utilized in the modular retaining wall of FIG. 1.

As demonstrated in FIG. 1, one type of modular block used in an embodiment of the disclosure is a "long horizontal block" or a standard block 32. FIG. 2 shows a top view of the long horizontal block 32. As shown, one embodiment of the long horizontal block includes side channels 92 and an interior opening or cavity 72 that extends through the block vertically (top-to-bottom). The side channels 92 and interior opening 72 of the wall block 32 reduces the amount of concrete or other materials needed to fabricate the block 32 and reduce the weight of the block 32 to simplify wall construction. The opening 72 of the wall block 32 is sized so as to maximize the strength of the block 32 while still permitting space for connecting anchoring structures to the wall 10, in some embodiments.

Further, locking means 62 are shown for securing another block positioned vertically atop the block 32. In accordance with the present disclosure, a variety of faces of the block may be used to provide a different texture and design to the wall. As represented by the solid line 33*a* in the figure, the long horizontal block may feature a multiple sides or multi-split configuration. Alternatively, in some embodiments, as represented by the dashed lines 33*b*, 33*c*, the face may feature offset splits, where one version of the block 32 has a face that is flush with line 33*b* and another version of the block 32 has a face that is flush with line 33*c*. Therefore, if these two versions of the block 32 are used in the same wall, the wall has a multi-textured appearance. In other embodiments, a segmental wall may be made from blocks of one type and version, such as a standard block 32, where the faces of the block are flush with each other, as they are stacked.

Figure 3:
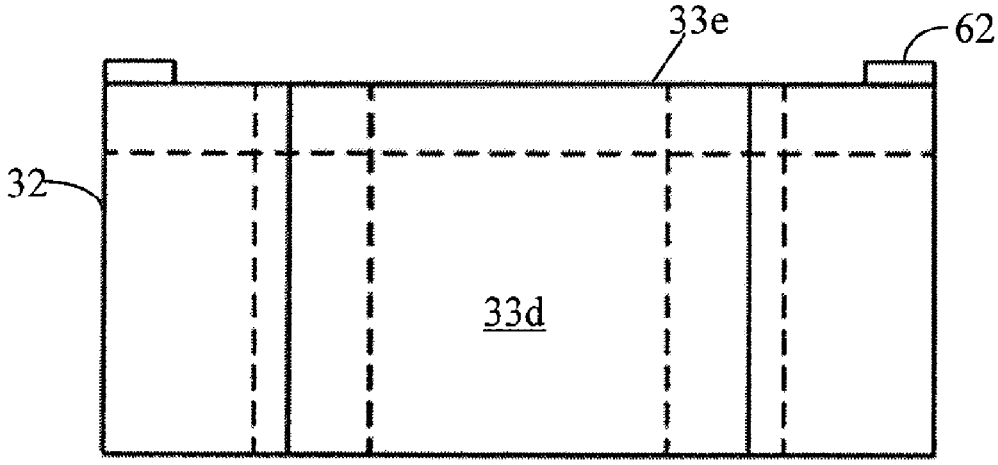
FIG. 3 is a diagram of a front view of the long horizontal block of FIG. 2.
Figure 4:
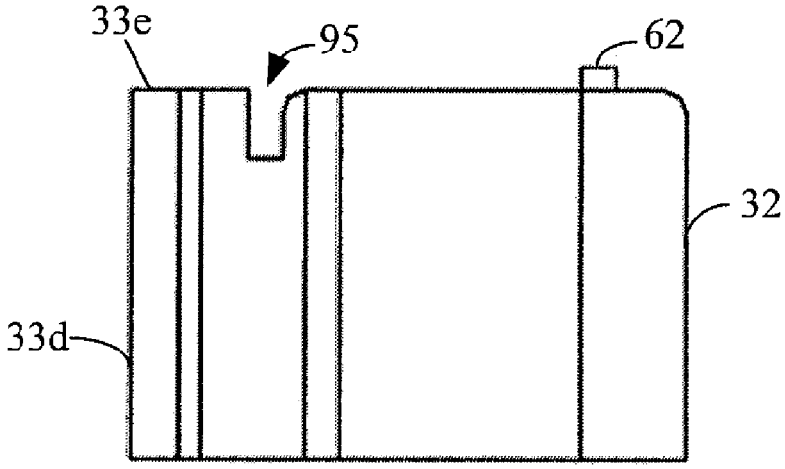
FIG. 4 is a diagram of a side view of the long horizontal block of FIG. 2.

Next, FIG. 3 shows a front view of the long horizontal block 32. In this view, the front face 33*d* and top surface 33*e* of the block is shown in relation to the locking means 62. Accordingly, FIG. 4 displays a side view of the long horizontal block 32. In this view, the locking means 62 is shown in relation to the front face 33*d* and a lateral alignment slot 95.

Figure 5:
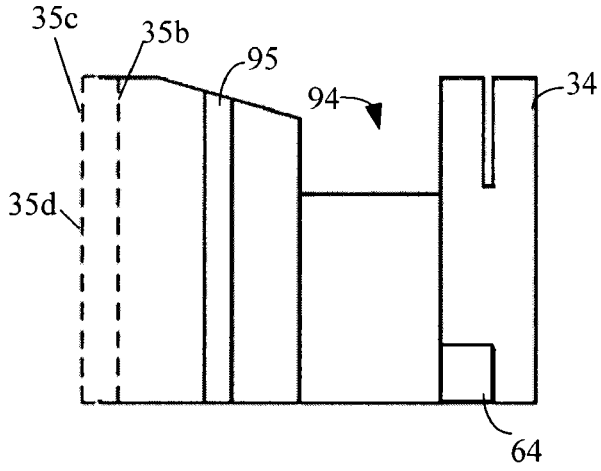
FIG. 5 is a diagram of a top view of one embodiment of a long vertical block that is utilized in the modular retaining wall of FIG. 1.

As demonstrated in FIG. 1, another type of modular block used in an embodiment of the disclosure is a "long vertical block" 34 which may be utilized with the long horizontal block 32 to form a retaining wall 10. FIG. 5 shows a top view of an embodiment of the long vertical block 34. As shown, the long vertical block 34 includes a side channel 94, a locking means 64, and a channel or lateral alignment slot 95. A variety of faces of the block 34 may used to provide a different texture and design to the wall. In some embodiments, as represented by the dashed lines 35*b*, 35*c*, the face of different versions of the block 34 may feature offset splits. In this way, a wall featuring the different versions of the block 34 will have a multi-textured appearance.

Figure 6:
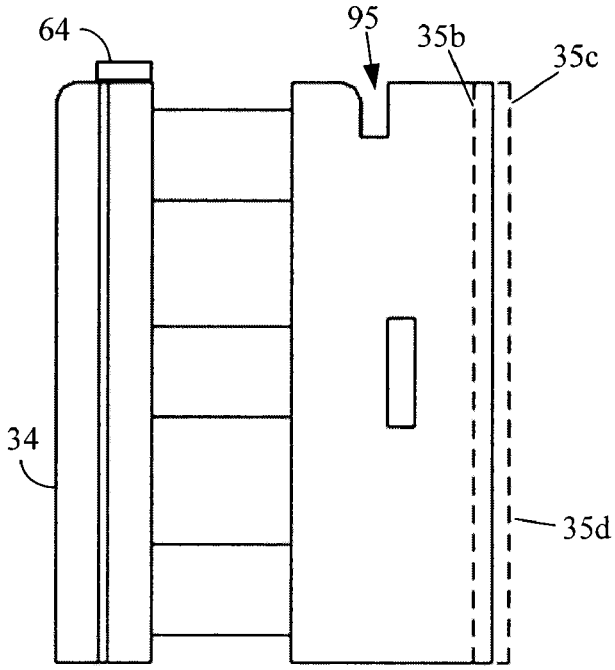
FIG. 6 is a diagram of a side view of the long vertical block of FIG. 5.

Next, FIG. 6 shows a side view of the long vertical block 34. In this view, the front face 35*d* of the block 34 is shown in relation to the locking means 64, and lateral alignment slot 95.

Figure 7:
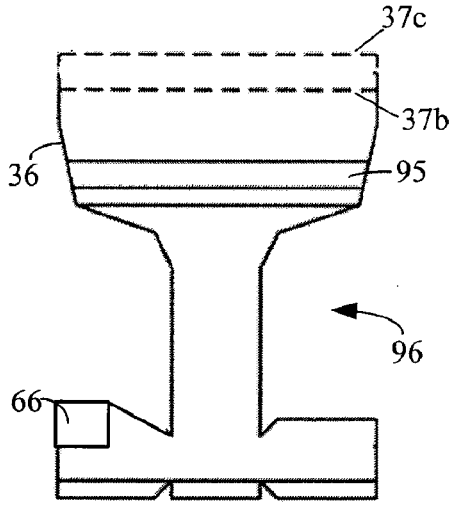
FIG. 7 is a diagram of a top view of one embodiment of a half block that is utilized in the modular retaining wall of FIG. 1.

Further, another type of modular block used in an embodiment of the disclosure is a "half block" 36. As shown in FIG. 1, the half block 36 may be used in a variety of patterns with the long horizontal block 32 and long vertical block 34 to form a modular retaining wall 10. FIG. 7 shows a top view of the half block 36. As shown, the half block includes side channels 96, locking means 66, and a lateral alignment slot 95. A variety of faces of the block 36 may used to provide a different texture and design to a modular retaining wall. As represented by the dashed lines 37*b*, 37*c*, faces of different versions of the block 36 may feature offset splits, in some embodiments.

Figure 8:
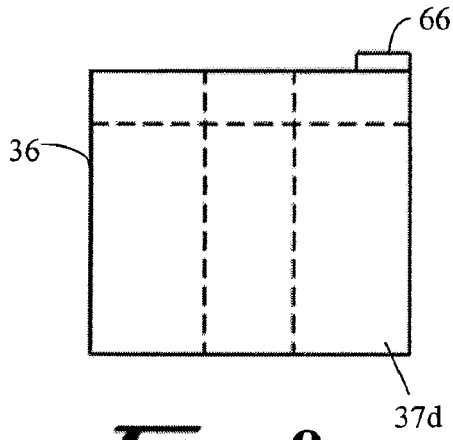
FIG. 8 is a diagram of a front view of the half block of FIG. 7.
Figure 9:
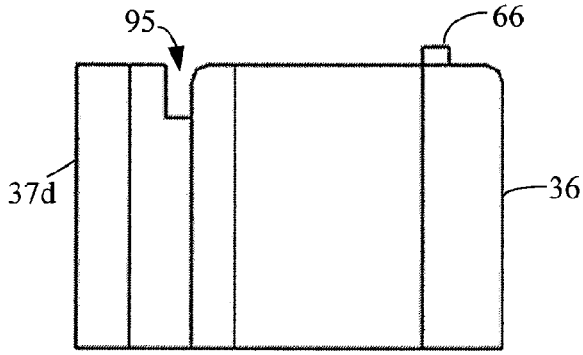
FIG. 9 is a diagram of a side view of the long horizontal block of FIG. 7.

Next, FIG. 8 shows a front view of the half block 36. In this view, the front face 37*d* of the block is shown along with the locking means 66. Accordingly, FIG. 9 displays a side view of the half block 36. In this view, the locking means 66 is shown in relation to the front face 37*d* and a lateral alignment slot 95.

In some embodiments, a modular retaining wall block system may be made utilizing shapes of different size, shape, and depth. For example, a wall may be made using the standard 32, vertical 34, and half blocks 36 as illustrated in FIG. 1. To add additional texture to the wall, the blocks 30 may be made at different depths by utilizing different versions of the blocks with different offsets of the face. U.S. Pat. No. 7,390,146, entitled "MODULAR BLOCK STRUCTURES", which is entirely incorporated herein by reference, describes modular block structures which may be utilized in modular retaining wall systems.

Figure 10:
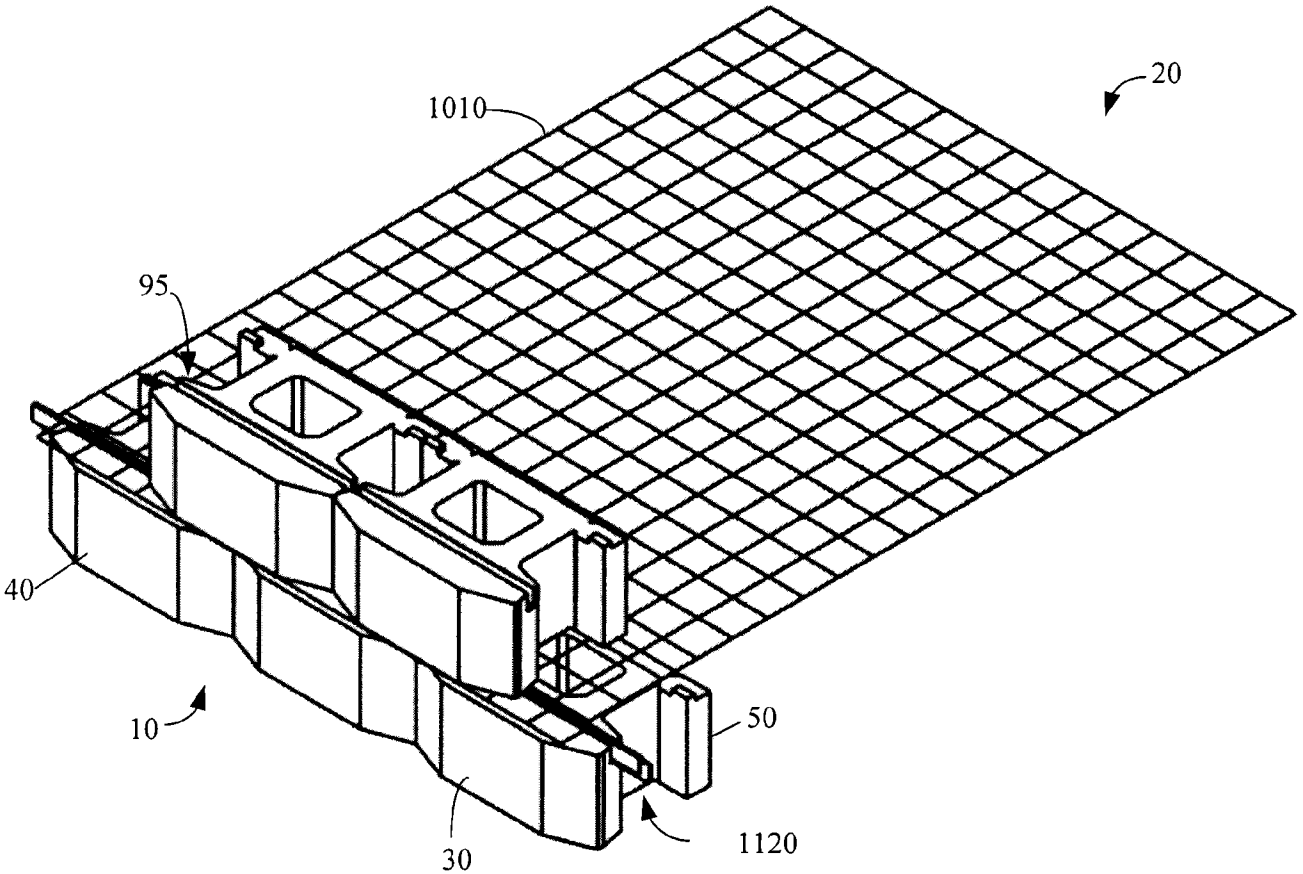
FIG. 10 is a diagram of a perspective view of one embodiment of an anchoring system constructed in accordance with the present disclosure.

FIG. 10 illustrates an embodiment 20 of an anchoring system constructed in accordance with the present disclosure. In this particular example, a retaining wall 10 is constructed with, but not limited to, standard blocks 32 with a multi-split face. As shown most clearly in FIG. 10, a reinforcement member 1010 extends from the exterior surface 40 of the retaining wall 10 into a lateral alignment slot 95 of the wall blocks 30, out from the interior surface 50 of the wall 10, and into a portion of an embankment. In particular, the reinforcement member 1010 may comprise a geogrid material in a lattice arrangement that comprises fabric composed of a polymeric material such as polypropylene or high tenacity polyester. These reinforcement members 1010 typically extend rearwardly from the wall 10 and into soil of the embankment to stabilize the soil against movement and thereby create a more stable soil mass which results in a more structurally secure retaining wall 10. In some embodiments, to secure the reinforcement members 1010 in the lateral alignment slot 95, a portion of the reinforcement member 1010 is positioned within the lateral alignment slot 95 and secured in place by one or more retaining members 1120. An optional configuration utilizing different blocks of different shapes and sizes and a random-like pattern, as shown in FIG. 1, is also able to utilize the geogrid anchoring system 20 utilizing retaining members 1120, as described.

Figure 11:
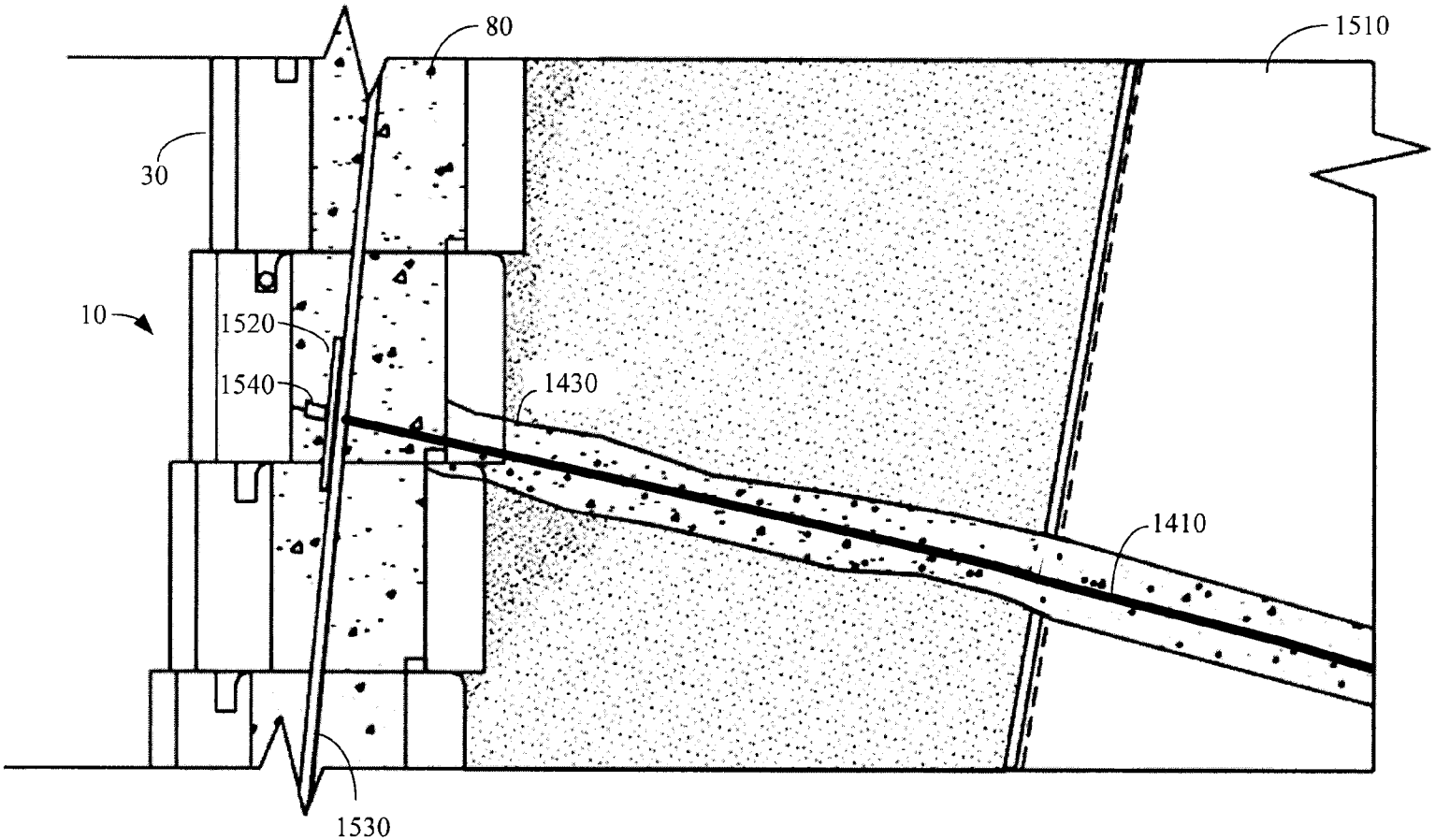
FIG. 11 is a diagram of a side view of another embodiment of an anchoring system constructed in accordance with the present disclosure.

In accordance with the present disclosure, another embodiment of an anchoring system for securing a retaining wall is shown with respect to FIG. 11. In this example, the retaining wall 10 is secured in several predetermined points with tieback connections. As shown in FIG. 11, each tieback rod 1410 extends through an opening 1430 formed in the rear surface of its respective wall block 30 such that a proximal portion of the rod 1410 extends into a continuous elongated passageway 80. Each of the tieback rods 1410 is secured in the earth of the embankment 1510 with conventional anchors (not shown).

As shown in FIG. 11, a tieback rod attachment mechanism 1520 (e.g., a steel plate) secures the tieback rod 1410 to the retaining wall 10. The attachment mechanism 1520 normally includes an elongated force distribution member 1530 (e.g., rebar rod) that extends through a portion of the vertical height of the continuous elongated passageway 80 or column formed by the surrounding block 30. Threaded onto each tieback rod 1410 is a conventional threaded fastener 1540 such as a nut which secures the attachment mechanism 1520 in position on the tieback rod 1410, thereby securing the rod to the wall 10. The continuous elongated passageway 80 is further encased in concrete after installation. The concrete with the blocks and the elongated force distribution member 1530 create a concrete reinforced beam that helps distribute the pressure from the earth anchor to the rest of the wall. U.S. Pat. No. 7,114,887, entitled "MODULAR BLOCK ANCHORING TECHNIQUES", which is entirely incorporated herein by reference, describes anchoring systems for securing modular retaining wall systems.

Figure 12:
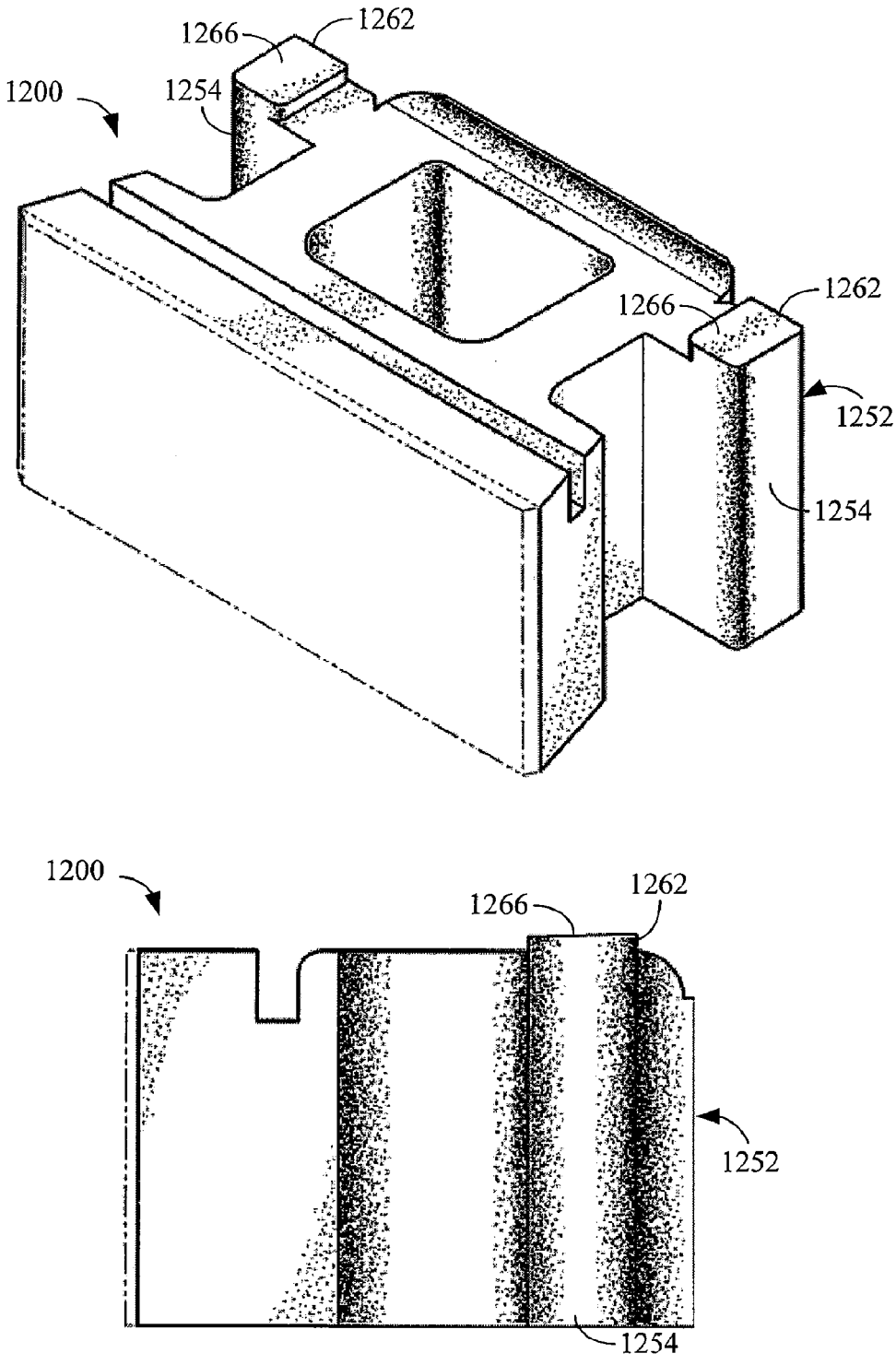
FIG. 12 is a diagram of perspective and side views of one embodiment of a long horizontal block that is utilized in the modular retaining wall of FIG. 1.

FIG. 12 illustrates an embodiment of a modular block 1200 in accordance with the present disclosure. In accordance with the present disclosure, a variety of faces of the block may be used to provide a different texture and design to the wall. In this exemplary modular block 1200, locking means 1262 are shown for securing another block positioned vertically atop the block 1200. In this exemplary embodiment, locking means 1262 extend over the entire width of protrusions 1254 extending along the rear portion 1252 of block 1200. The locking means 1262 includes an upper surface 1266. As illustrated in FIG. 11, the locking means 1262 may be used to align ascending rows of blocks 30 (FIG. 1). The width of locking means may be varied to provide different setbacks. Other geometric configurations such as, but not limited to, cylinders and geometric prisms may also be utilized for the locking means 1262. While the embodiment of FIG. 12 includes two locking means 1262, other embodiments may include one or more locking means 1262 to align ascending rows of blocks 30.

Figure 13:
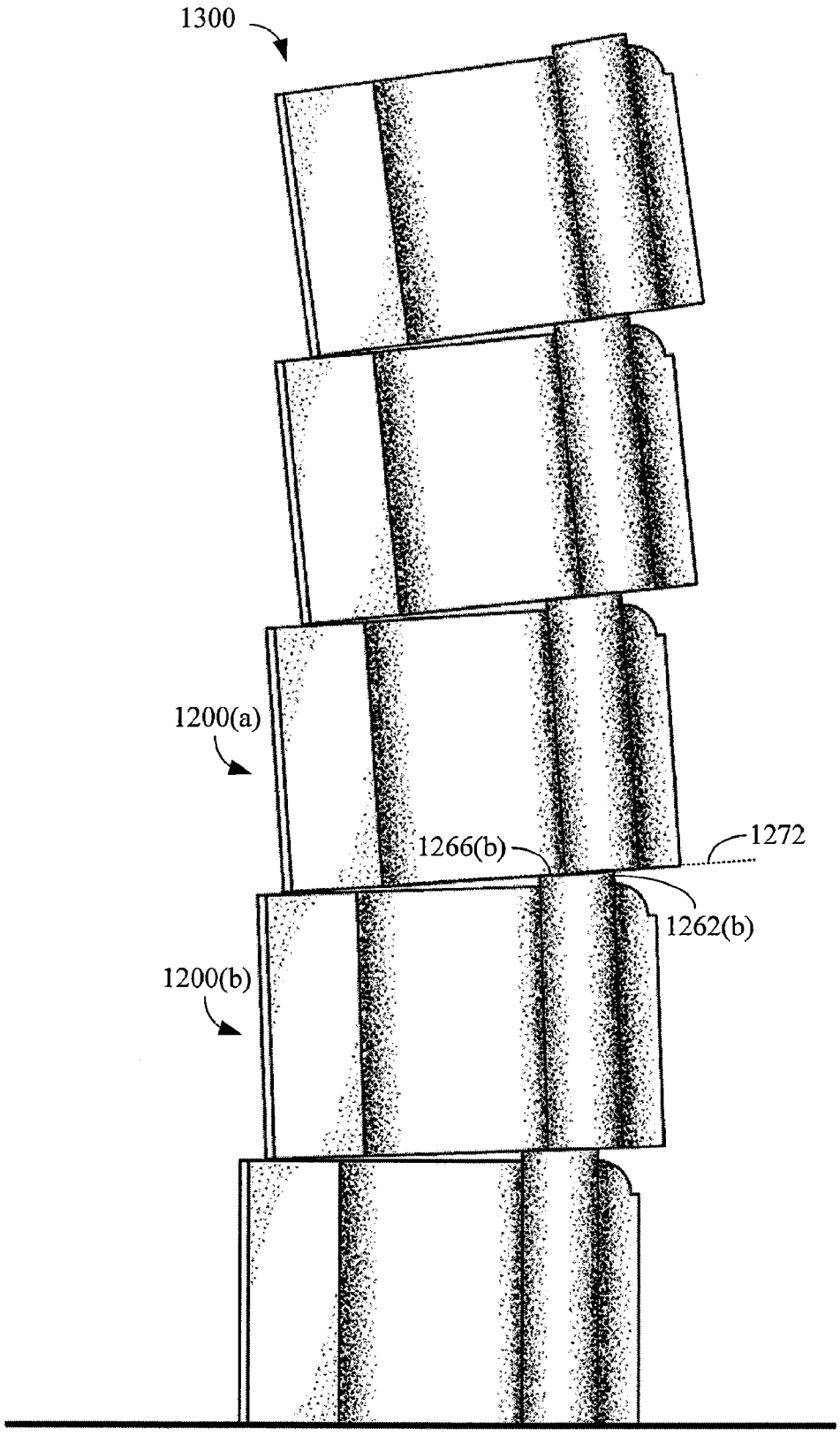
FIG. 13 is an illustration of the blocks of FIG. 12 stacked for storage and/or transportation in accordance with the present disclosure.

FIG. 13 illustrates the modular blocks 1200 of FIG. 12 stacked 1300 for storage and/or transportation in accordance with the present disclosure. When stacked as shown in FIG. 13, a block 1200(*a*) is supported by the top surface of block 1200(*b*) and the upper surface 1266(*b*) of locking means 1262(*b*). To reduce damage to the locking means 1262 when the blocks 1200 are stacked, the upper surface 1266 of the locking means 1262 may be angled downwardly form rear to front. This angled arrangement can provide a larger area for force distribution and reduce the stress seen at the upper surface edges of the locking means 1262. In one embodiment, voids are provided in the bottom surface of the block 1200 to receive the locking means 1266. In some embodiments, surfaces of the void mirror the surfaces of locking means 1262. Angling of the upper surface of the locking means may also be utilized on the long horizontal block 32, the long vertical block 34, and the half block 36 described above.

Figure 14:
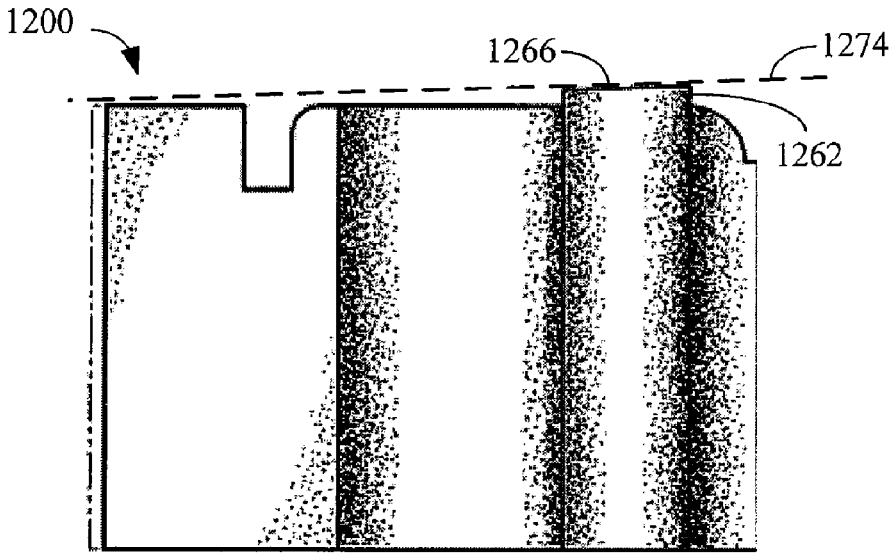
FIG. 14 is a diagram of side views of embodiments of the block of FIG. 12 illustrating different angling of the upper surface of the locking means in accordance with the present disclosure.
Figure 14:
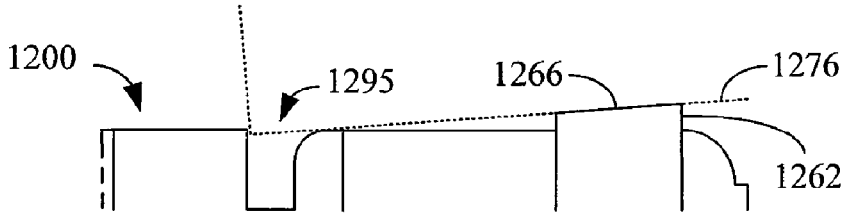
Figure 14:
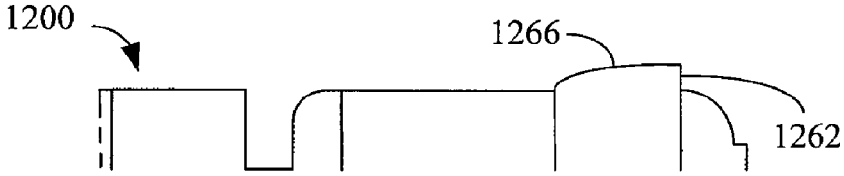

In the exemplary embodiment of FIG. 13, the angle of the upper surface 1266 of the locking means 1262 is aligned such that, when block 1200(*a*) is placed on the upper surface 1266(*b*) of locking means 1262(*b*), the front edge of the bottom surface of block 1200(*a*) rests on the top surface of block 1200(*b*) as illustrated. The angle of the upper surface 1266(*b*) is indicated by the line 1272 running from the rear edge of the upper surface 1266(*b*) of locking means 1262(*b*) to where the front edge of the bottom surface of block 1200(*a*) rests on the top surface of block 1200(*b*). In one embodiment, voids are provided in the bottom surface of the block 1200(*a*) to receive the locking means 1262(*b*). Other embodiments of angled locking means are illustrated in FIG. 14.

In the embodiment of FIG. 14(A), the angle of the upper surface 1266 of the locking means 1262 of a block 1200 is indicated by the line 1274, which runs from the rear edge of the upper surface 1266 of locking means 1262 to where the front edge of top surface of block 1200. Alternatively, in the embodiment of FIG. 14(B), the angle of the upper surface 1266 of the locking means 1262 of a block 1200 is indicated by the line 1276, which runs from the rear edge of the upper surface 1266 of locking means 1262 to the rear edge of the lateral alignment slot 1295.

In another embodiment illustrated in FIG. 14(C), the angle of the upper surface 1266 of the locking means 1262 of a block 1200 varies from the rear to the front of the locking means 1262. In the embodiment of FIG. 14(C), the downward angle increases from rear to front of the locking means 1262. As shown in FIG. 14(C), this produces a curved upper surface 1266. The curved upper surface 1266 allows a block to be supported by a curved linear surface independent of its positioning on the lower block. The curved upper surface 1266 reduces the stress seen at the upper surface edge at the front of the locking means 1262.

Figure 15:
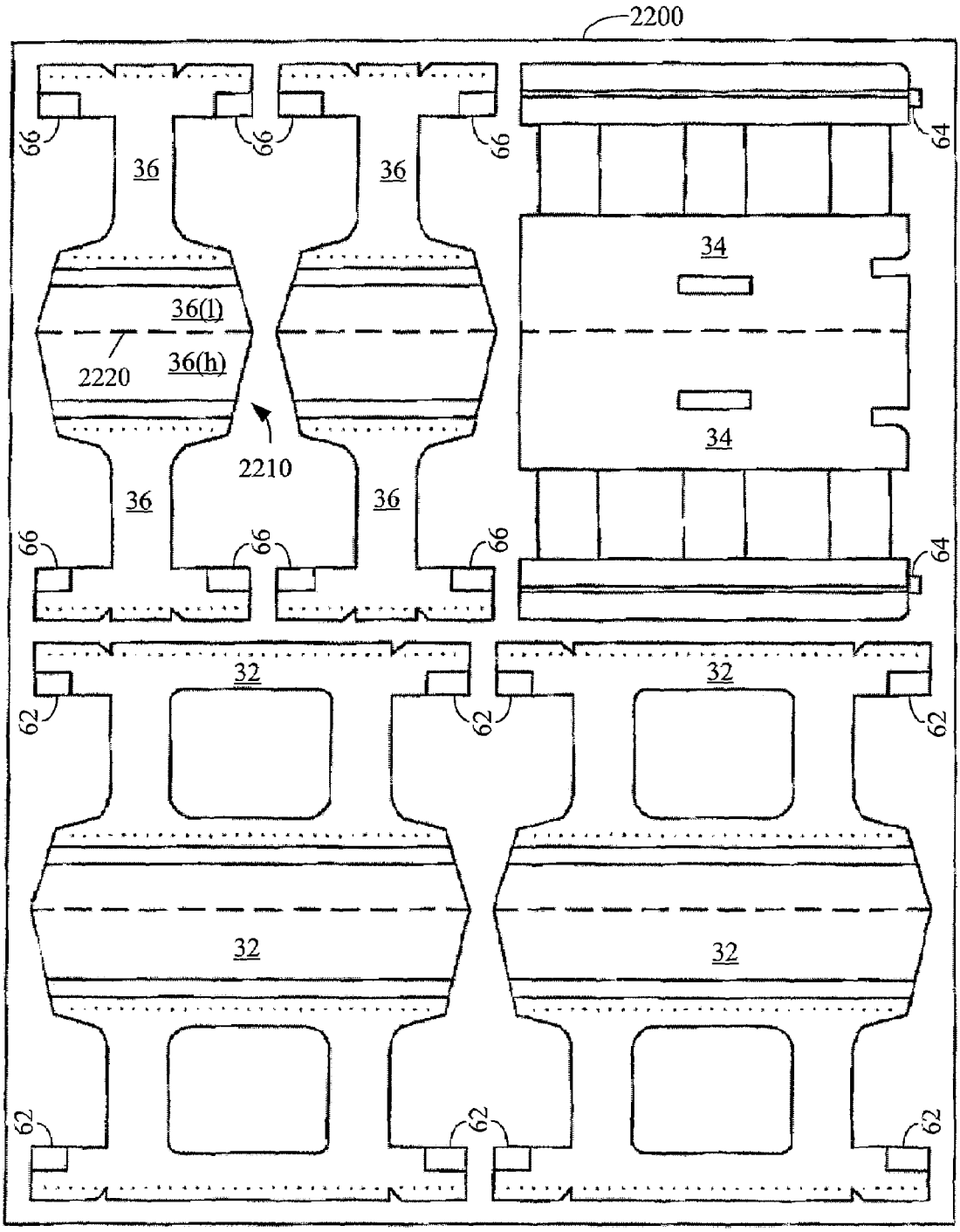
FIGS. 15-16 are diagrams of embodiments of a mold for forming wall blocks utilized in the wall structure described in FIG. 1.

FIG. 15 shows an exemplary embodiment of a mold system for producing wall blocks of three different size, shapes, and depth. As shown, with a single mold 2200, four standard or horizontal blocks 32, two vertical blocks 34, and four half blocks 36 are produced. Further, different versions of the blocks 32, 34, 36 are produced with a split offset to produce blocks of different depth. For example, a pair 2210 of half blocks 36 is arranged with each block positioned face to face. Therefore, after a concrete mixture is poured into the mold and set, the pair of blocks are split, in an offset manner, along the dashed line 2220 produce a "high" block 36(*h*) and a "low" block 36(*l*). This procedure is performed for each pair of blocks formed by the mold 2200. By utilizing blocks produced from this mold 2200 in an undesignated pattern results in a multi-textured wall without a set pattern. Angling of the upper surface of the locking means 62, 64, 66 improves the molding process by reducing vacuum during head stripping of the mold 2200.

Figure 16:
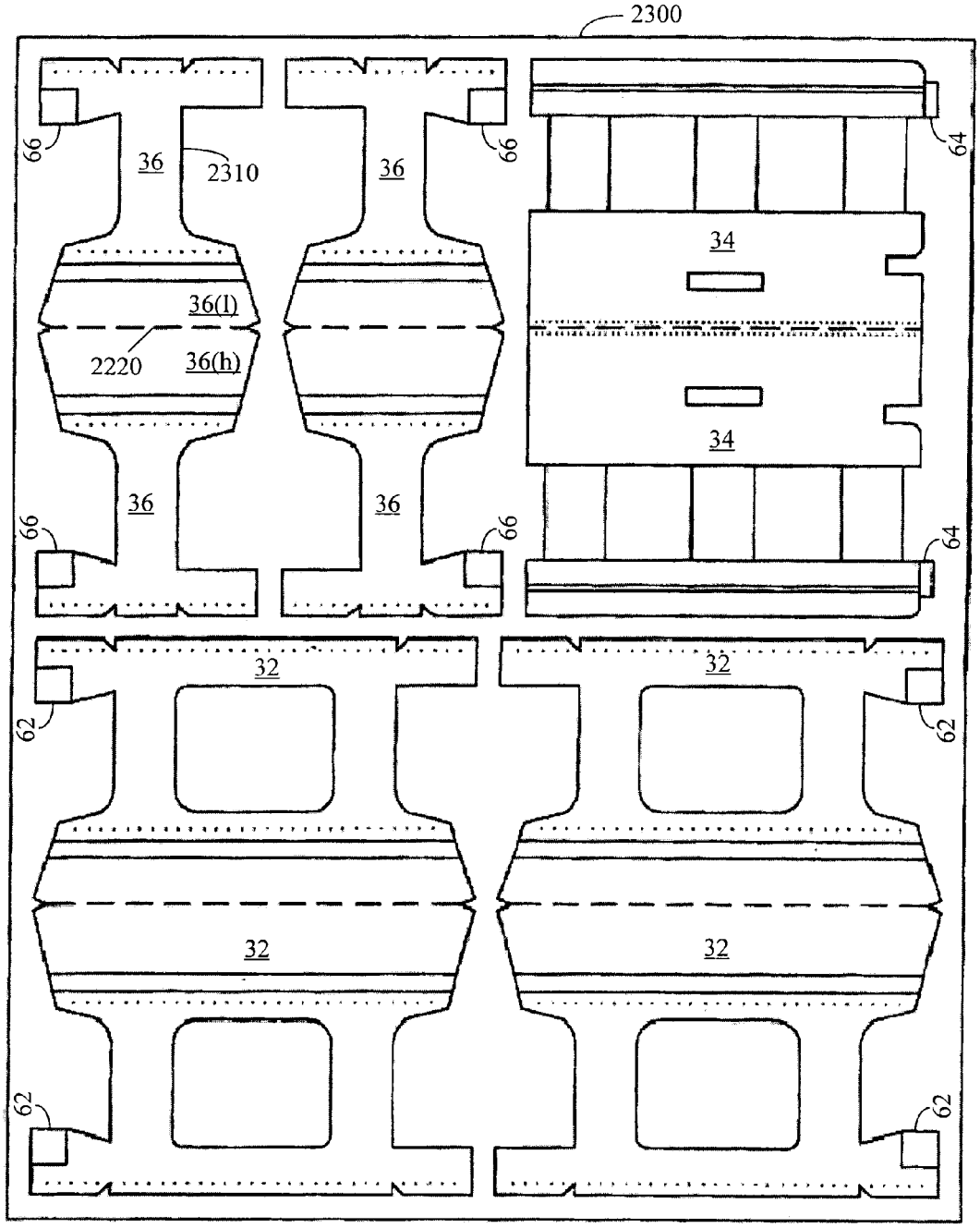

Note that in an alternative embodiment, a mold 2300, such as that represented in FIG. 16 may be provided. Here, the locking means 62, 64, 66 or node on the rear portion of the block 2310 is enlarged and provided only on one side of a respective block. With this approach, the enlarged node may provide additional security in adjoining other blocks positioned above and also allow for flexibility in positioning neighboring blocks on the same tier or course. Reference characters are repeated in FIG. 16 for corresponding parts that are also included in FIG. 15. Other combinations and/or configurations of locking means may be utilized in other embodiments.

It should be emphasized that the above-described embodiments of the present disclosure are merely possible examples of implementations, merely set forth for a clear understanding of the principles of the disclosure. Many variations and modifications may be made to the above-described embodiments of the disclosure without departing substantially from the spirit and principles of the disclosure. All such modifications and variations are intended to be included herein within the scope of this disclosure.

The invention claimed is:

1. An interlocking retaining wall block, adapted for assembly into a retaining wall including a plurality of stacked rows of at least a plurality of said blocks, said block comprising:

left, right, front and rear body portions, said front and rear body portions of said block being connected by said left and right body portions, defining a void therebetween;

left and right protruding body portions, said left and right protruding body portions extending outwardly in left and right directions from said left and right body portions, respectively;

left and right aligning elements extending upwardly from an upper surface of said left and right protruding body portions, respectively, each of said aligning elements located forward of an exterior face of said rear body portion and rearward of an interior face of said front body portion on each of said left and right protruding body portions, each of said aligning elements having an upper surface that is angled downwardly from rear to front, each of said aligning elements being operable to be received by a void of another one of said blocks; and a substantially planar bottom surface of said block.

2. The block of claim 1, further comprising a second set of left and right protruding body portions, said second set of left and right protruding body portions extending outwardly in left and right directions from said left and right body portions, respectively, and wherein said first and second sets of left and right protruding body portions define side voids of left and right sides of said block, said side voids being generally half the size of said void defined by said left, right, front and rear body portions.

3. The block of claim 1, further comprising a channel passing between left and right sides of said block for receiving geogrid material and a retainer for said geogrid material.

4. The block of claim 1, wherein said aligning elements are positioned on said upper surface of said left and right protruding body portions so that an upper row of blocks is horizontally offset in a backward direction from said block.

5. The block of claim 1, wherein the upper surface is angled downwardly at a constant angle from rear to front.

6. The block of claim 1, wherein the upper surface is angled downwardly at a varying angle from rear to front.

* * * * *